United States Patent [19]

Smith, Jr.

[11] Patent Number: 4,507,816

[45] Date of Patent: Apr. 2, 1985

[54] WATERBED WITH SOUND WAVE SYSTEM

[76] Inventor: Gray H. Smith, Jr., 1257 Cherokee Rd., Louisville, Ky. 40204

[21] Appl. No.: 564,110

[22] Filed: Dec. 21, 1983

[51] Int. Cl.[3] ..... A47C 31/00; A47C 27/08

[52] U.S. Cl. ..... 5/451; 179/146 H; 381/24

[58] Field of Search ..... 5/451, 400, 452, 450, 5/449, 508; 297/217; 128/33; 179/146 H; 381/24

[56] References Cited

U.S. PATENT DOCUMENTS

| | | | |
|---|---|---|---|
| 2,821,191 | 1/1958 | Pall | 179/146 H |
| 3,909,531 | 9/1975 | Plummer | 381/24 |
| 4,023,566 | 5/1977 | Martinmaas | 128/33 |
| 4,064,376 | 12/1977 | Yamada | 297/217 |
| 4,124,249 | 11/1978 | Abbeloos | 297/217 |
| 4,125,912 | 11/1978 | Courter | 5/400 |
| 4,160,296 | 7/1979 | Fogel | 5/400 |

*Primary Examiner*—Alexander Grosz

*Attorney, Agent, or Firm*—Richard L. Caslin

[57] ABSTRACT

A standard waterbed is shown having added thereto a sound wave system having four loudspeaker housings positioned within the floor pedestal of the bed beneath the supporting deck for the water-filled bladder mattress. Each of these loudspeaker housings is an airtight, acoustically insulated loudspeaker enclosure that supports a loudspeaker in the top portion thereof which faces upwardly to be in alignment with the plurality of openings formed through the deck. These loudspeakers are wired to an external balance control box that includes a volume control as well as a left and right hand and a head and foot speaker volume control capability. This external balance control box is wired to a stereo amplifier of a stereo radio and/or phonographic sound system, whereby the sound waves projected from the loudspeakers cause waves to form in the water within the mattress so that a person reclining on the mattress will feel as well as hear the sound and music passing through the mattress.

2 Claims, 4 Drawing Figures

WATERBED WITH SOUND WAVE SYSTEM

BACKGROUND OF THE INVENTION

1. Field of the Invention

This invention relates to radio and stereophonic sound systems and in particular to such sound systems that are especially designed for waterbeds such that a plurality of loudspeakers are arranged within the floor pedestal of the waterbed and of such a design as to create sound waves as well as water waves in the water-filled bladder mattress of the waterbed so that a person reclining on the bed will both feel as well as hear the sound within the water-filled mattress.

2. Description of the Prior Art

The Paii U.S. Pat. No. 2,821,191 describes a treating table, not a bed, to provide a pulsating device that includes controlled sound, light and electrical vibrations that are adapted to tone up physically both healthy and sick persons. The pulsating device is of a type where the pulsation is synchronized with a musical score, permitting the user to "feel" the music as it is played. The musical score controlling the pulsations may be played from either a built-in radio or a phonograph. The loudspeaker is not directly associated with the top surface of this treating table.

The Betts U.S. Pat. No. 3,872,526 describes a vibratory waterbed that includes an electrical motor that drives an eccentric weight for transmitting vibrations of the motor housing to a flexible sheet supported in the side of the open frame construction that contains the water-filled bladder mattress. There is no sound system combined with this vibratory mechanism.

The Nohmura U.S. Pat. No. 3,880,152 describes a health promoting device for use with either a reclining chair or a bed which is fitted with a vibrating system by the use of the propagation of sound wave amplitude by use of loudspeakers. Rhythmical vibrations are generated by the loudspeaker, thereby giving a massaging effect and improving the blood circulation. Nothing is said in this patent about a waterbed. The user is supported on a flexible sheet, such as a tarpaulin-like material or a synthetic resin tightly extended across the framework. The loudspeakers are not assembled within an acoustically-enclosed housing.

The Martinmaas U.S. Pat. No. 4,023,566 discloses the use of loudspeakers in either chairs or beds, where one or more loudspeakers are mounted within a chamber to produce vibrations within the chamber which are transmitted through the body-supporting means to an occupant thereof. This patent describes the philosophy of receiving the direct vibrations of the music through other parts of the body than the ears. No mention is made in this patent of a water-filled mattress.

The Raffel U.S. Pat. No. 4,105,024 describes a waterbed which is characterized as "massaging furniture". There is no teaching of a sound-producing system for creating the massaging wave frequency. This patent uses nonrotating vibrator motors that include a magnet coil and an armature, where a part of the motor is secured to rigid means of the bed to vibrate and impart vibrations to the rigid means.

The Santo U.S. Pat. No. 4,114,215 describes a waterbed having a unitary accessory control at one side of the bed near the head thereof. This control includes sound-producing equipment which may be as simple as a single rest inducing tone generator or as complex as a multiplex AM/FM stereo radio and tape deck. There is apparently no connection between this sound-producing equipment and the water-filled bladder mattress.

The Hale et al U.S. Pat. No. 4,141,096 describes a mechanical method and means for producing motion in waterbeds. An electric motor drives a disc that is fitted with a crank arm that is joined to a triangular-shaped lifting member. There is no pleasant sound system connected with this mechanical means for imparting motion to the water filling the waterbed.

The McMullan et al U.S. Pat. No. 4,187,568 describes a waterbed having a vibratory transducer which incorporates an electromagnetic vibrator unit which is fixed to the underside of a plate. Thus the plate is vibrated by the vibrator and moves or vibrates substantially independent of another body. There is no sound connected with this vibratory transducer. This patented design is creating mechanical vibrations to transmit vibratory motion through the water-filled mattress.

The last patent is to Christensen U.S. Pat. No. 4,232,661 which shows a complex electronic circuit system having a vibrator motor in combination with a waterbed mattress for administering massage actions to a person resting on the mattress. There is apparently no teaching in this patent of a sound-producing system for imparting vibrations to the waterbed mattress.

OBJECTS OF THE PRESENT INVENTION

The principal object of the present invention is to provide a sound wave system for use with a waterbed where the sound is directed upwardly through the deck of the bed that supports the water-filled mattress so that both sound waves and water waves travel through the mattress causing vibrations that are synchronized with the sound for the enjoyment of the person reclining on the bed.

A further object of the present invention is to provide a sound wave system of the class described where each loudspeaker is mounted in the top portion of an airtight, acoustically insulated loudspeaker enclosure, where this enclosure extends from the floor to the deck of the bed that supports the water-filled bladder mattress.

A further object of the present invention is to provide the sound wave system of the class described with four loudspeaker housings that are each located in one of the four quadrants of the floor pedestal of the waterbed measured from head to foot and from left to right.

A further object of the present invention is to provide the sound wave system of the class described where the loudspeakers are wired through an external balance control box which is in turn wired to a stereo amplifier of a stereo sound system thereby allowing sound separation in both left and right sides as well as from head to foot of the bed.

SUMMARY OF THE INVENTION

The present invention provides a waterbed sound wave system for use with a standard waterbed that has a floor pedestal that supports a planar deck which in turn supports an open frame construction that confines a water-filled bladder mattress. This sound wave system has four loudspeaker housings that are each located in one of the four quadrants of the floor pedestal measured from head to foot of the pedestal as well as from left to right thereof. Each loudspeaker housing is an airtight, acoustically insulated enclosure that extends from the floor to the planar deck. A loudspeaker is positioned in the upper portion of this housing and it faces in an upward direction. Suitable openings are formed in the deck in the area that is aligned with each loudspeaker housing. These loudspeakers are wired to an external balance control box which is in turn wired to a stereo amplifier.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
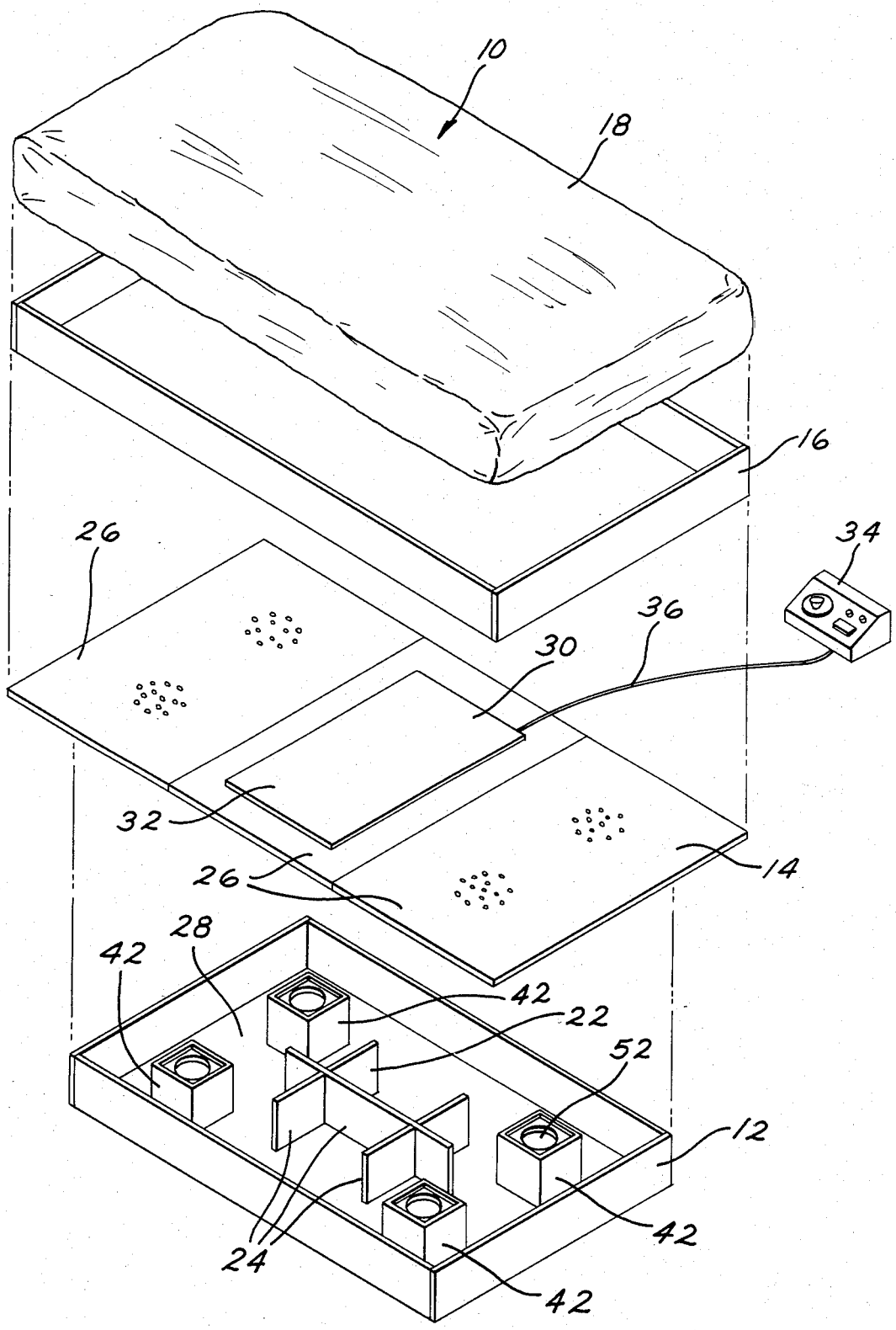
FIG. 1 is an exploded perspective view of a waterbed that is fitted with the sound wave system of the present invention, where the floor pedestal of the waterbed is shown at the bottom of the view, and it incorporates four loudspeaker housings that are each located in one of the four quadrants of the floor pedestal.

Turning now to a consideration of the drawings, and, in particular, to the exploded perspective view of FIG. 1, there is shown a waterbed 10 having a floor pedestal 12, a planar deck 14 that in turn supports a box-like open frame 16 within which a water-filled bladder mattress 18 is confined.

The floor pedestal 12 is a box-like open frame that is generally smaller in length and width than the box-like open frame 16 that confines the mattress. This floor pedestal 12 is formed by using vertical planks that are fastened together at the corners. Particle board is widely used in this art for constructing the floor pedestal. Because of the heavy weight of the water within the mattress 18, a central pedestal support structure 22 of three interlocking panels 24 is positioned within the interior of the floor pedestal to serve as an additional vertical support means. This central pedestal support structure 22 is not attached to the floor pedestal, but it is merely centrally located within the floor pedestal but independent thereof. The height of the three vertical interlocking panels 24 is the same as the height of the planks which form the box-like open frame of the floor pedestal 12.

The planar deck 14 is larger in size than the length and width of the floor pedestal 12, and it is about the same size as the box-like open frame 16 that confines the mattress 18. This deck 14 is shown as three separate, heavy plywood panels 26 which are transversely arranged across the floor pedestal 12. Since the floor pedestal 12 sits directly on the floor 28, and since the top of the floor pedestal is covered by the planar deck 14, the interior of the floor pedestal comprises dead airspace. As is conventional in this art, a waterbed heating system 30, which comprises a large electric heating pad 32, is mounted on the central plywood panel 26. This heating pad 32 includes a remote temperature control box 34 with a variable temperature control, as well as an interconnecting electric cord 36.

The box-like open frame 16 is of substantially the same expanse as the planar deck 14 and is supported directly therefrom, as is clear from FIG. 1. This open frame 16 serves not as a vertical support means for the mattress 18, but rather it serves as a containment for the side walls of the water-filled bladder mattress 18. Of course, this waterbed 10 would be fitted with a fabric mattress pad on the top thereof, as well as a fitted mattress sheet (not shown).

Figure 2:
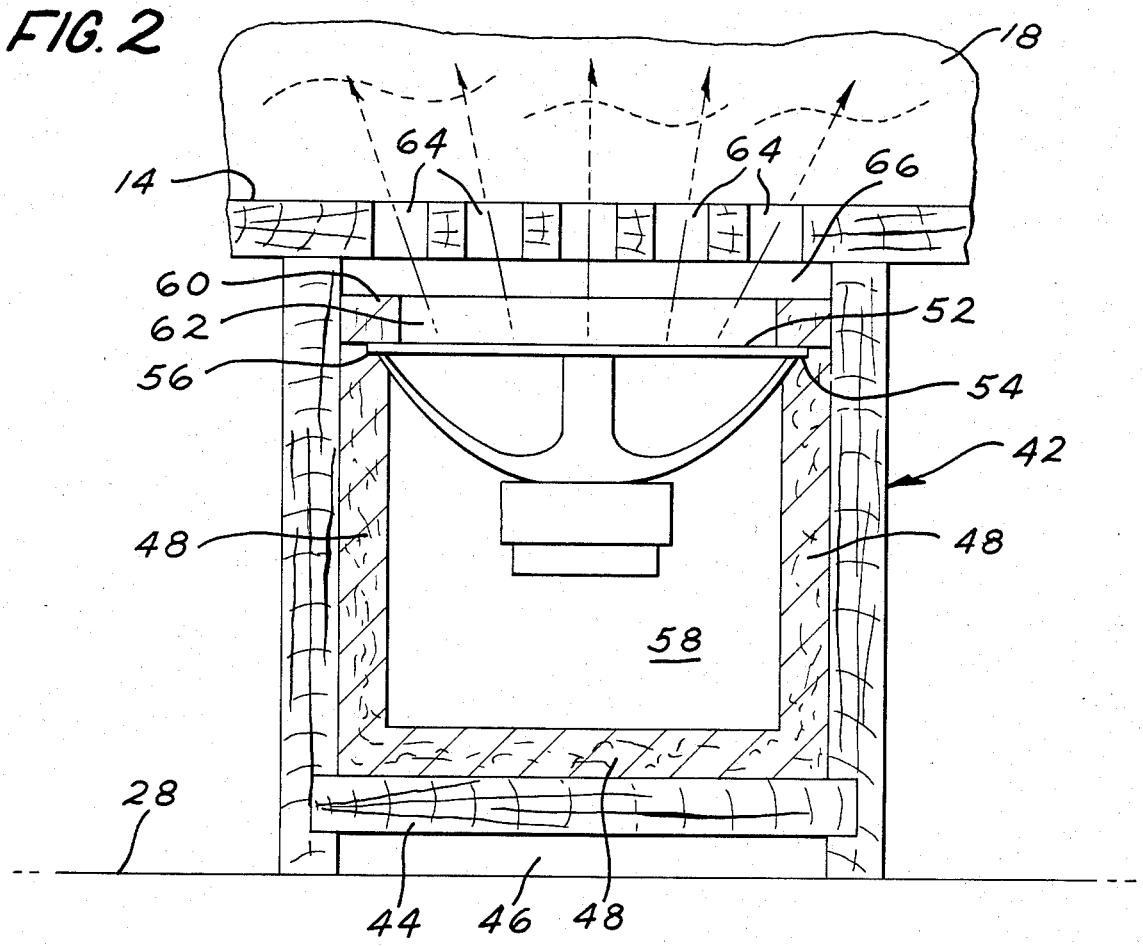
FIG. 2 is a cross-sectional elevational view through the center of one of the loudspeaker housings, on a larger scale, showing the details of its construction relative to the deck which is supported on the top of the housing, and it, in turn, supports the water-filled bladder mattress.
Figure 3:
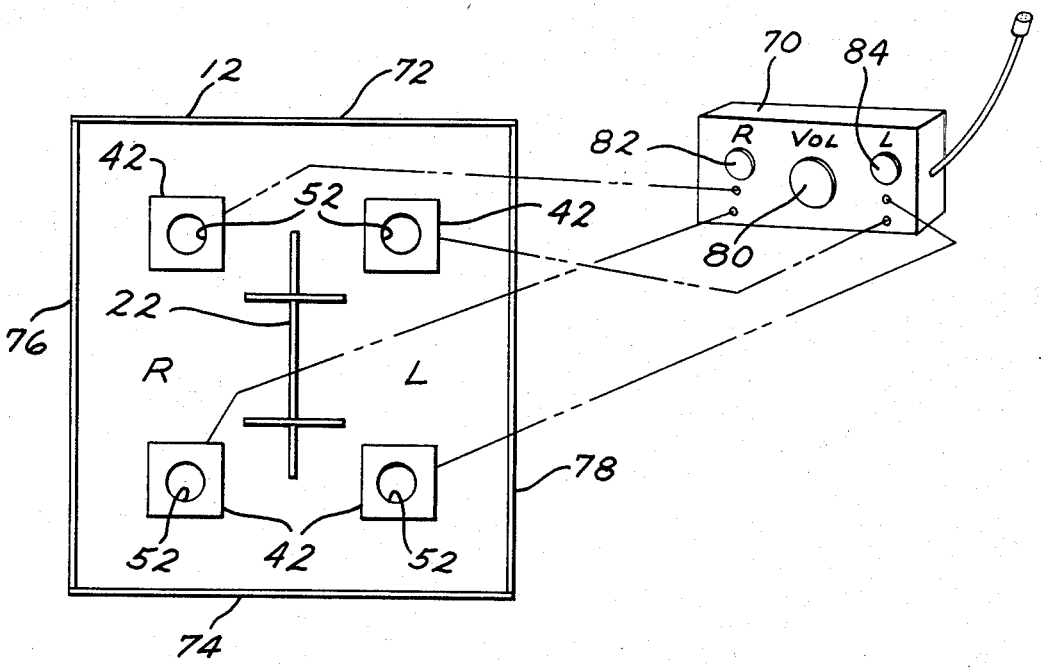
FIG. 3 is a top plan view of the floor pedestal, again showing the four loudspeaker housings that are each located in one of the four quadrants of the floor pedestal measured from head-to-foot of the pedestal as well as from left-to-right thereof. This Figure also shows a schematic diagram of these four loudspeakers connected to an external balance control box to allow for sound separation in both left and right sides as well as from head-to-foot of the bed.

As is seen in both FIGS. 1 and 3, the foor pedestal 12 is provided with four loudspeaker housings 42 that are each adapted to be located in one of the four quadrants of the floor pedestal measured from head-to-foot thereof, as well as from left-to-right thereof. All four loudspeaker housings 42 are identical, and one of them is shown in detail in FIG. 2. This is a cross-sectional elevational view through the center of the housing 42. This housing is of hollow, vertical tubular construction that is fashioned from wood or heavy particle board and is generally square in plan view. The height of the housing is substantially equal to the height of the floor pedestal frame 12, such that the housing 42 sits squarely on the floor 28, and it extends upwardly to be in contact with the underside of the planar deck 14, such that the housing 42 is an airtight loudspeaker enclosure. Raised from the bottom of the enclosure 42 is a bottom panel 44 that seals the bottom of the housing and creates a dead airspace 46 between this raised bottom panel 44 and the floor 28. A blanket of sound insulating material 48 covers the top of the raised bottom panel 44 as well as the floor interior side walls of the housing 42. Each airtight, acoustically insulated loudspeaker housing 42 supports an 8-inch full range speaker 52, which is located in the upper portion of the housing 42 and directed to project the sound in an upward direction by having its peripheral flange 54 seated on a recessed ledge 56 which is formed in the top surface of the vertically arranged sound insulating layers 58 on the interior walls of the housing 42. Thus, a second dead airspace 58 is created within the housing 42 beneath the speaker 52 and above the raised bottom panel 44. The loudspeaker 52 is mounted firmly in place by a top panel 60 that fits down inside the top opening of the housing 42 and bears against the peripheral flange. This top panel 60 has a large central opening 62 that is aligned with the throat of the speaker so as not to muffle the sound emanating therefrom. Notice that a plurality of small openings 64 are formed through the deck 14 in the area that is aligned with the top opening of the housing 42, again so as not to muffle and sound emanating from the loudspeaker. Thus, a third dead airspace 66 is formed above the speaker 52 and below the water-filled bladder mattress 18.

Turning now to a consideration of FIG. 3, the floor pedestal 12 is shown in top plan view, and the central pedestal support structure 22 is shown in place for supporting the three plywood panels 26. The placement of the loudspeaker housings 42 is determined by dividing the floor pedestal 12 into four imaginary quadrants, where each housing 42 is placed substantially in the center of each quadrant.

Figure 4:
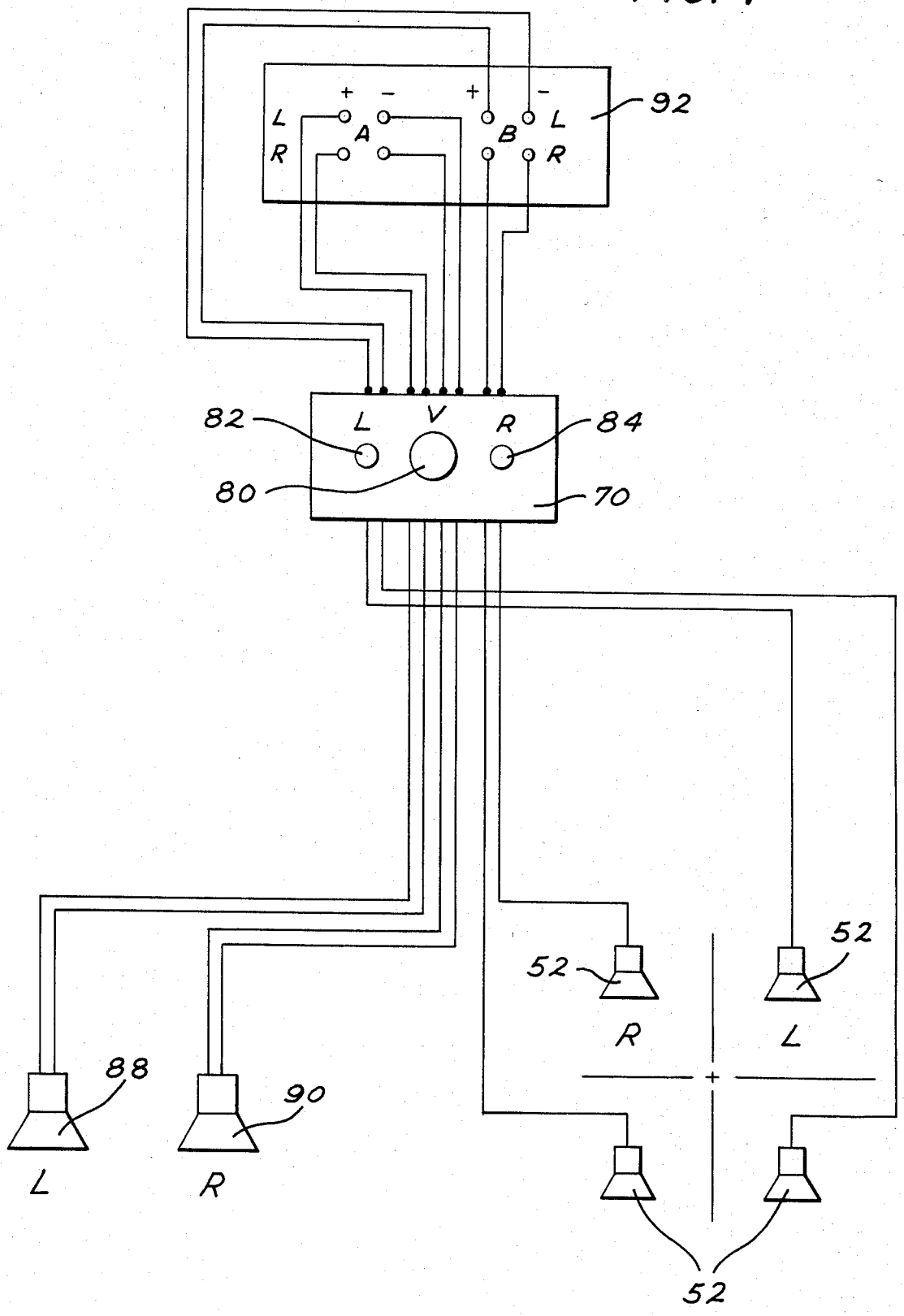
FIG. 4 is a schematic wiring diagram for the sound wave system of the present invention, where the four loudspeakers are connected through an external balance control box to a stereo amplifier means of a stereo radio sound system that includes standard loudspeakers for deployment around the room.

A balance control box 70 is used in this sound wave system by being located outside of the floor pedestal 12 near to one side of the bed so as to be accessible to a person reclining on the bed. In FIG. 3, the head 72 of the bed is at the top of the figure, and the foot 74 of the bed is at the bottom of the figure. Thus, the right side 76 of the bed is at the left of the figure, and the left side 78 is at the right side of the figure. The balance control box 70 has a volume control 80 and a left channel control 82 and a right channel control 84. This balance control box 70 serves several purposes. A standard pair of external stereo loudspeakers 88 and 90 would probably be combined with this waterbed sound wave system for normal use when the sound wave system is not being used, or to be used in conjunction with the four loudspeakers 52. These standard external speakers 88 and 90 are connected back to the volume control 80 of the balance control box 70, as is best seen in FIG. 4. Thus, this balance control box 70 is used in this sound wave system to achieve head/foot and left/right balance control. One alternative would be to replace the two separate control knobs 82 and 84 with a single, omni-directional joy stick (not shown) to provide a simpler control means. Since a greater volume is required to operate the speakers 52 of this waterbed sound wave system, as opposed to the volume needed with the external speakers 88 and 90, a separate volume control 80 is required to lower the intensity of the sound in the external speakers 88 and 90 to a tolerable level. This volume control 80 is a simple potentiometer. The left channel control 82 and the right channel control 84 are simple faders allowing the user to adjust the head/foot levels of this sound wave system's left and right channels.

As is best seen in FIG. 4, the balance control box 70 is connected back to the amplifier 92 that has a four speaker capability as well as left/right balance control.

The purpose of this waterbed sound wave system of the present invention is to create for the user a pleasing musical effect within the water-filled mattress 18. Several factors contribute to this effect. The principal effect for the user is the actual distribution of sound within the mattress. It will be understood by those skilled in this art that variables in the number of speakers, the placement, size, capability and specifications thereof may be made without departing from the scope of this invention. The four speaker system described above is the preferred embodiment because it has provided the most pleasing results during extensive experimentation. This "four quadrant" system allows sound separation in left/right and head/foot capability. It has also been learned that a "full range" type speaker delivered the most pleasing tonal quality. The speaker size and the power handling ability, like the potentiometer 80 and the faders 82 and 84 in the balance control box 70, will be determined by the power of the user's amplifier 92. It will also be understood that the balance control box 70 could be incorporated with the remote temperature control box 34 to form a single modular unit.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. In combination with a waterbed having a floor pedestal of open frame construction including a separate internal pedestal support of vertical partitions both supporting a planar deck which, in turn, supports a second open frame construction within which a water-filled bladder mattress is confined; the invention comprising:

a. a waterbed sound system having four loudspeaker housings that are each adapted to be located in one of the four quadrants of the floor pedestal measured from head to foot of the pedestal as well as from left to right thereof;

b. each loudspeaker housing being of vertical tubular construction having a height substantially equal to the height of the said pedestal frame, the sides and bottom of the tubular housing including layers of acoustic insulation, a loudspeaker positioned in the upper portion of the tubular housing and facing in an upward direction;

c. a plurality of openings formed through the deck in the area that is aligned with the top portion of each loudspeaker housing;

d. said loudspeakers being wired to an external balance control box having a first volume control as well as a left and right hand as well as head and foot speaker volume control capability;

e. said external balance control box being wired to a stereo amplifier means of a stereo radio sound system;

f. wherein each loudspeaker housing is positioned near the center of one of the four quadrants of the floor pedestal, where the loudspeaker housings are surrounded by dead-air space within the floor pedestal, and extra acoustic insulation is positioned in the bottom portion of each loudspeaker housing to reduce the possibility of sound traveling down through the floor supporting the waterbed.

2. The invention as recited in claim 1 wherein each loudspeaker housing actually maximizes the sound compression or projection in an upward direction through the deck and into the water in the bladder mattress, while the combination of the balance control box and the four quadrant loudspeaker deployment allows sound separation in both left and right sides as well as from head to foot of the bed.

* * * * *